US006739399B2

(12) United States Patent
Wagner et al.

(10) Patent No.: US 6,739,399 B2
(45) Date of Patent: May 25, 2004

(54) INERTING METHOD AND APPARATUS FOR PREVENTING AND EXTINGUISHING FIRES IN ENCLOSED SPACES

(76) Inventors: Ernst Werner Wagner, Posener Strasse 1, D-29308 Winsen (DE); Volker Schütte, Auf dem Ziegenberg 6, D-30900 Wedemark (DE)

( * ) Notice: Subject to any disclaimer, the term of this patent is extended or adjusted under 35 U.S.C. 154(b) by 0 days.

(21) Appl. No.: 10/338,289

(22) Filed: Jan. 8, 2003

(65) Prior Publication Data

US 2003/0094288 A1 May 22, 2003

Related U.S. Application Data

(63) Continuation of application No. 09/949,045, filed on Sep. 7, 2001, now abandoned, which is a continuation-in-part of application No. 09/485,364, filed as application No. PCT/EP99/01021 on Feb. 17, 1999, now abandoned.

(30) Foreign Application Priority Data

Mar. 18, 1998 (DE) ..... 198 11 851

(51) Int. Cl.[7] ..... A62C 2/00
(52) U.S. Cl. ..... 169/45; 169/46; 169/54
(58) Field of Search ..... 169/43, 45, 46, 169/54

(56) References Cited

U.S. PATENT DOCUMENTS 3,438,445 A * 4/1969 MacCracken ..... 169/44
4,846,410 A * 7/1989 Jewett et al. ..... 241/31
6,634,598 B2 * 10/2003 Susko ..... 244/135 R

* cited by examiner

*Primary Examiner*—Christopher S. Kim
(74) *Attorney, Agent, or Firm*—Cesari and McKenna, LLP

(57) ABSTRACT

Inerting method and apparatus reduce the risk of and extinguish fires in an enclosed space. The method provides that the oxygen content in the space is reduced to a set base inerting level and, in the event of a fire, is quickly further reduced to a complete inerting level. For carrying out the method, the apparatus includes an oxygen measuring device for the enclosed space, with a first system for producing the oxygen-expulsion gas or for extracting oxygen from the enclosed space, with a second system for rapidly feeding an oxygen-expulsion gas into the space being monitored, and with a fire detection device for detecting a fire characteristic in the enclosed space. A control unit sends a base inerting signal to the first system in accordance with the oxygen content in the enclosed space, and sends a complete inerting signal to the second system in accordance with a detection signal from the fire detection device.

11 Claims, 2 Drawing Sheets

INERTING METHOD AND APPARATUS FOR PREVENTING AND EXTINGUISHING FIRES IN ENCLOSED SPACES

CROSS-REFERENCE TO RELATED APPLICATIONS

This application is a continuation of Ser. No. 09/949,045, filed Sep. 7, 2001, now abandoned, which is a continuation-in-part of Ser. No. 09/485,364, filed Feb. 8, 2000, now abandoned, which is the national Stage of PCT/EP99/01021 filed Feb. 17, 1999.

BACKGROUND OF THE INVENTION

The present invention relates to an inerting method for reducing the risk of, and for extinguishing, fires in enclosed spaces, and to apparatus for carrying out this method.

In the case of enclosed spaces into which human beings or animals enter only occasionally, and installations which are impacted adversely by water, it is known to lessen the risk of fires by reducing the oxygen concentration in the area in question to an average value of about 12%. Given this oxygen concentration, most combustible materials can no longer burn. The areas concerned are mainly data processing areas, electric switch and distribution rooms, enclosed installations and storage areas containing high-grade valuable goods.

The extinguishing effect resulting from this method is based on the principle of oxygen expulsion. It is known that the normal ambient air consists of 21% oxygen, 78% nitrogen and 1% other gases. For fire extinction, the nitrogen concentration in the space concerned may be further increased by introducing pure nitrogen so as to reduce the oxygen portion. It is known that an extinguishing effect commences once the oxygen content falls under 15% by volume. Depending upon the combustible materials in the space concerned, it may be required to further reduce the oxygen content to the mentioned 12% by volume.

With said "inert gas extinguishing technique", as the flooding of a fire hazardous or burning space with oxygen-expulsion gases such as carbon dioxide, nitrogen, rare gases and mixtures thereof is called, the oxygen-expulsion gases are usually stored in a compressed manner in steel cylinders in specific side rooms. In the case of need, the gas is then conducted into the space in question by means of piping systems and corresponding exit nozzles. Fire extinction by means of the inert gas extinguishing technique, however, encounters certain problems and has clear limits in view of the size of the space. Large spaces having, for instance, a basic area of 20×50 m and a 6.5 m height result in a volume of 6,500 $m^3$. In accordance with the known standards, the steel cylinders used are those having a volumetric capacity of 80 l. Inert gas extinction facilities are filled with a pressure of 200 bar, which is presently the upper standard parameter due to the ultimate loading capacity of the available armatures. With a cylinder pressure of 200 bar, an 80 l, cylinder for example, holds 18.3 kg of nitrogen resulting in 16 $m^3$ nitrogen in the relaxed state at 1 bar ambient pressure. In order to flood the aforementioned space having a volume of 6.500 $m^3$ with inert gas, the contents of about 300 steel cylinders would be required. In a filled state, such a cylinder has a weight of about 100 kg, which, given 300 cylinders, would result in a weight of 30 tons.

In addition there would be the weight of the pipes and armatures, so that very high demands would have to be made on the load ability of the store rooms. Moreover, a large floor space would be required for such a number of cylinders.

Thus, it is evident that the inert gas extinction technique in connection with larger spaces encounters problems in view of the storability and the carrying capacity of the store rooms. To store the cylinders in a cellar is not a satisfying solution either, although the carrying capacity there is not of importance. Long conduits would have to be laid from the cellar to the upper floors involving additional construction labor, which frequently cannot be coped with later, and moreover prolongs the flow-in time of the inert gas, in an inappropriate manner.

SUMMARY OF THE INVENTION

It is an object of the present invention, therefore, to provide an inerting method for reducing the risk of fires and for extinguishing fires in enclosed spaces, allowing an effective extinction of a fire while keeping the storing volume of the inert gas cylinders at a minimum.

Said object is provided by means of an inerting method of the above-mentioned kind comprising the following steps: at first, the oxygen content in the enclosed space is reduced to a selected base inerting level of, for example, 16%, and in the event of a fire, the oxygen content is further reduced to a selected complete inerting level of, for example, 12% by volume or less. A base inerting level of an oxygen concentration of 16% by volume does not entail any risk for persons or animals, so that they can still enter the space without any problems. The complete inerting level can either be adjusted at night when no persons or animals are likely to enter the space in question, or directly in response to a detected fire. With an oxygen concentration of 12% by volume, the flammability of most materials has already been sufficiently reduced so that they can no longer start to burn.

The present method is particularly advantaged in that the number of containers for oxygen-expulsion inert gases required in the event of a fire is clearly reduced. Thus, the total costs of the fire prevention and extinction system is considerably reduced. Furthermore, from a constructional aspect, a smaller pressure relief facility for the space is required, because in the event of a fire, only a smaller gas volume has to flow in during the short time available, for which a constructional relief facility has to be provided.

DETAILED DESCRIPTION OF AN ILLUSTRATIVE EMBODIMENT

Figure 1:
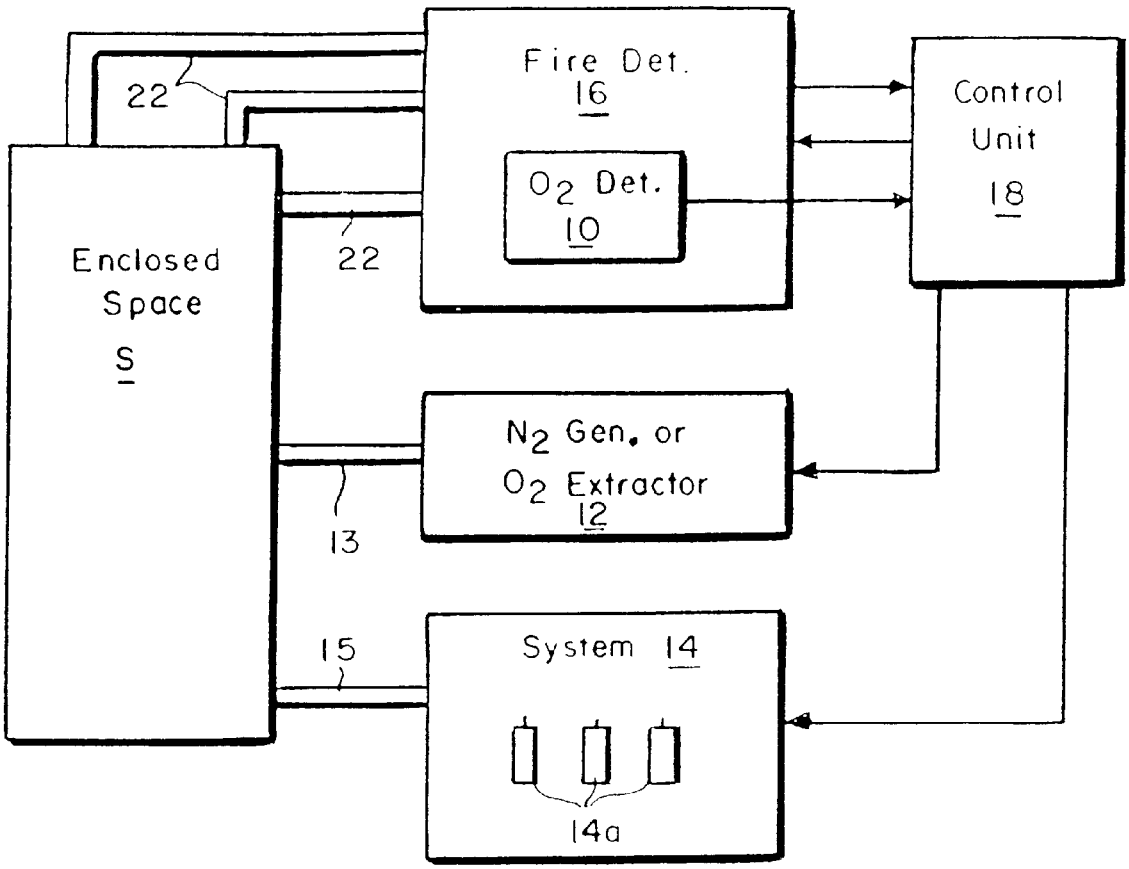
FIG. 1 is a block diagram of apparatus incorporating the invention.

As shown in FIG. 1, the aforementioned object is carried out by means of apparatus for carrying out said method, comprising the following components: an oxygen measuring device 10 for the space S being monitored; a first system 12 for producing the oxygen-expulsion gas or for extracting oxygen via a pipe 13 from the space being monitored; a second system 14, comprising gas cylinders 14*a*, for rapidly feeding an oxygen-expulsion gas via a pipe 15 into the space being monitored; and a fire detection device 16 for detecting a fire-characteristic in the air of the enclosed space S. For providing a solution to the desired object, a control unit 18 is provided which sends a base inerting signal to the first system 12 for producing the oxygen-expulsion gas or for extracting the oxygen in accordance with the oxygen content of the air in the enclosed space S being monitored, and which sends a complete inerting signal to the second system 14 in accordance with a detection signal from the fire detection device. Thereupon, system 14 delivers oxygen-expulsion gases via a pipe 15 to space S.

Said inventive apparatus realizes in an ideal manner the connection of the inventive method with a fire detection device. The control unit according to the invention for sending the base inerting signal and the complete inerting signal thereby takes into account the particular conditions of the space being monitored, the base inerting level of which was previously calculated on the basis of size and type of the space.

The inerting method advantageously comprises the following additional two process steps, which are carried out before the first process step, namely the reduction of the oxygen content to a set base inerting level. In accordance with said embodiment, the oxygen content in the spaces being monitored is first measured, whereupon the reduction to the base inerting level is carried out in a second process step in response to the measured value of the oxygen. Thus, the inerting method adjusts to certain leakages in the space by means of a classical regulation of the oxygen content in the space being monitored.

A detector for fire characteristics is advantageously integrated into the method, which sends a complete inerting signal in the event of a fire.

Representative air samples are, for instance, constantly extracted from the air in the space being monitored prior to the reduction to a selected complete inerting level, by which samples are fed to a detector for fire characteristics, which sends a complete inerting signal in the event of a fire. Said embodiment is the process-technical conversion of the connection of a known aspirative fire detection device with the inert gas extinction technique. An aspirative fire detection device hereby refers to a fire detection device actively drawing in a representative portion of the air in the space at a plurality of locations via piping 22 (FIG. 1) and feeding said portion to a measuring chamber comprising a detector for detecting a fire characteristic.

The term "fire characteristic" refers to physical parameters being subject to measurable changes in the environment of an originating fire, for example, the ambient temperature, the solid or liquid or gas contents in the ambient air (formation of smoke in the form of particles or aerosols or vapor) or the ambient radiation.

The method can be carried out in a particularly advantageous manner, if the base inerting level is implemented by means of mechanical production and subsequent introduction of oxygen-expulsion gases, or by means of mechanical oxygen extraction. This is feasible in so far as more time is available for the reduction to the base inerting level, so that a gradual reduction of the oxygen content in the corresponding space by means of a machine is sufficient. In contrast thereto, an introduction of oxygen-expulsion gases into the enclosed space is preferably provided for rapidly obtaining the complete inerting level, wherein basically all inert gases may be used. Said inert gases may advantageously be provided in the gas cylinders 14*a* in system 14, since even with larger spaces S, the volume to be filled between the base inerting level and the complete inerting level no longer causes problems. Moreover, a mechanical production of oxygen-expulsion gases, for instance by means of nitrogen generating machine 12, is a great advantage, since also gas cylinders 14*a* being responsible for the complete inerting can be refilled by the use thereof.

It has finally been provided as an advantage that the introduction of oxygen-expulsion gases is carried out in accordance with the oxygen content measured in the enclosed space, whereby it is achieved that only the amount of gas being required for the complete inerting is fed at all times.

It has already been mentioned that it is one of the advantages of the inventive method that it can be combined with the known fire detection devices. In so-called aspirative fire detection devices, it is necessary to constantly control the flow rate of the drawn-in representative air portions. According to an embodiment of the inventive device, it is provided that the oxygen measuring device for carrying out the method is integrated in the detector housing 16*a* of the fire detection device 16, where also the air flow monitoring device 16 is disposed, as shown in FIG. 1.

The production of the oxygen-expulsion gases for obtaining the base inerting level is advantageously implemented mechanically by means of the nitrogen generating machine 12 or the like. It has already been mentioned that also the gas cylinders 14*a* in system 14 responsible for the complete inerting can thereby be refilled in an advantageous manner, once they have been emptied.

Figure 2:
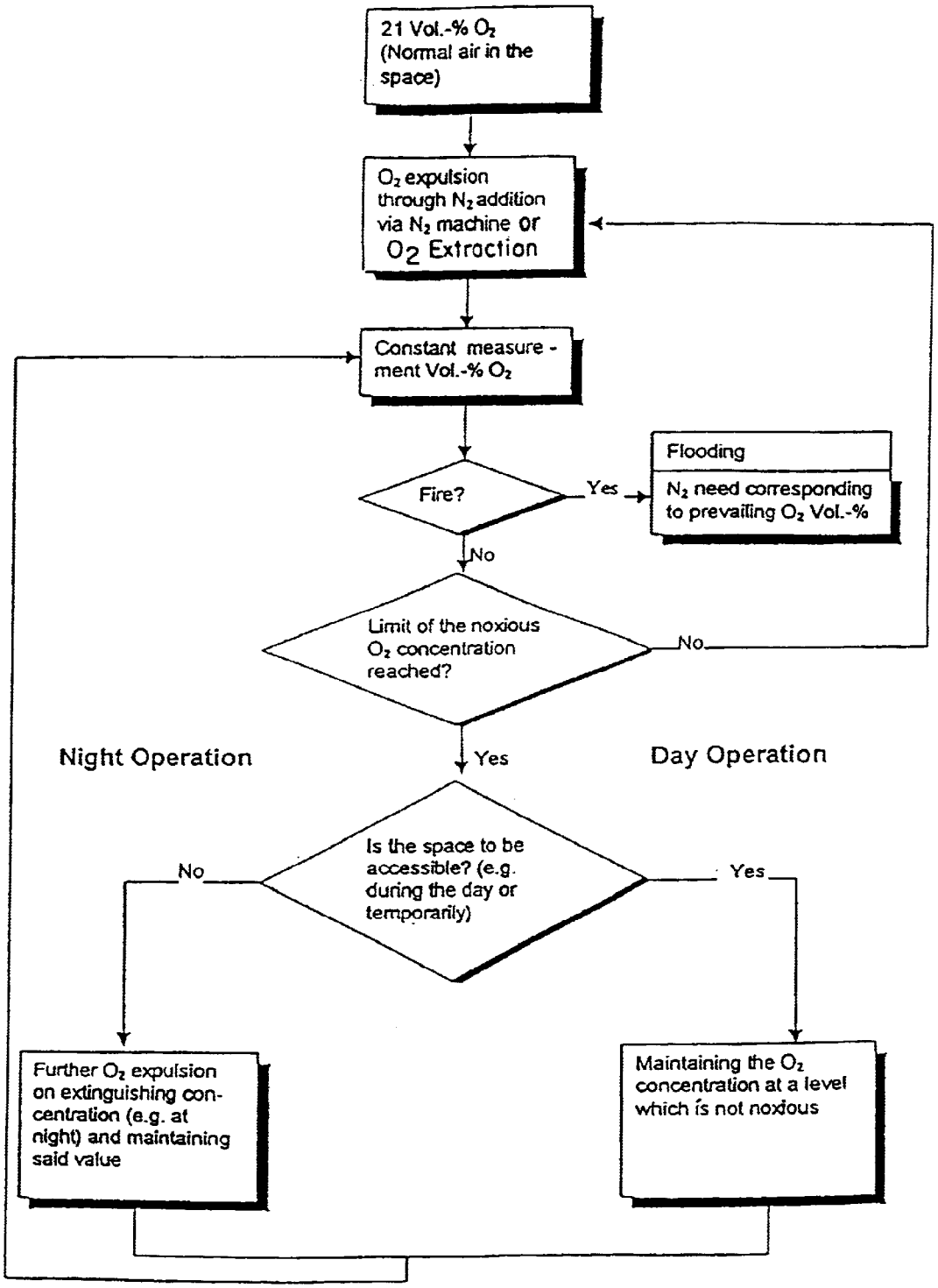
FIG. 2 is a flow chart illustrating various steps in the subject method.

The inventive method is explained in more detail by means of the FIG. 2 flow chart.

According to the invention, an enclosed space containing normal air with the common oxygen content of 21% by volume is to be monitored. In order to reduce the risk of a fire, the oxygen content in the enclosed space is reduced to a set base inerting level by means of introducing nitrogen from a nitrogen machine or by extracting oxygen. The oxygen content in the space being monitored is constantly measured before and simultaneously with the reduction to the base inerting level. The target value was previously calculated on the basis of the properties of the space and the equipment therein, e.g. data processing apparatus and the like. An aspirative fire detection device being provided with a detector for fire characteristics constantly draws in representative portions of the air in the space via a piping or channel system and feeds said portions to the detector for the fire characteristics. If a fire characteristic is detected and, with the usual safety loops, recognized as a fire, the space is rapidly flooded with nitrogen from steel cylinders until a desired oxygen concentration is obtained. Said concentration was previously determined on the basis of the combustible materials in the space.

As long as there is no fire, it is constantly checked by means of the oxygen measuring device, to see whether a lower threshold value of a noxious oxygen concentration is reached. If this is still not the case, the nitrogen machine still receives the base inerting signal and continues to flood the space with nitrogen. If the noxious threshold value is reached, the target value is inquired as to whether the conditions for a night operation or the conditions for a day operation are to be established. If the space is no longer to be entered by persons or animals, the complete inerting signal is sent to the nitrogen machine, whereupon another oxygen expulsion takes place in accordance with the measured oxygen content, until the extinguishing concentration predetermined for the space and the materials contained therein is reached. If the space, however, is still to be entered, the oxygen concentration is maintained at a non-noxious value of about 16% by means of the oxygen measuring device 10.

What is claimed is:

1. An inerting method for reducing the risk of and for extinguishing fires in enclosed spaces, said method comprising the steps of monitoring the oxygen content in a wall-enclosed space to produce measured oxygen values;

when said measured oxygen values exceed a selected base inerting level capable of reducing the risk of combustion yet supporting life, reducing the oxygen content in said space to said selected base inerting level;

in the event of a fire in said space, detecting selected fire characteristics in said space and producing a complete inerting signal, and in response to said complete inerting signal, rapidly further reducing the oxygen content in said space to a selected complete inerting level incapable of supporting combustion.

2. The method according to claim 1, wherein the detecting step includes constantly extracting representative samples of the air in said enclosed space for preventing a fire, and feeding the samples to a fire characteristics detector to produce said complete inerting signal.

3. The method according to claim 1, wherein said oxygen content in the enclosed space is reduced to the selected base inerting level by producing and/or introducing an oxygen-expulsion gas into the enclosed space.

4. The method according to claim 1, wherein the oxygen content in the enclosed space is reduced to the selected base inerting level by extracting oxygen from the enclosed space.

5. The method according to claim 1, wherein the further reduction step includes the introducing of an oxygen-expulsion gas into the enclosed space.

6. The method according to claim 5, wherein said oxygen-expulsion gas is introduced from gas cylinders.

7. The method according to claim 3, including the step of controlling the producing and/or introducing said oxygen-expulsion gas into the enclosed space in accordance with the measured oxygen content in the enclosed space.

8. Inerting apparatus for carrying out the method according to claim 1, said apparatus including a nitrogen generating machine.

9. Inerting apparatus for carrying out the method according to claim 1, said apparatus comprising an oxygen measuring device for measuring the oxygen content in said enclosed space for preventing a fire and producing a base inerting signal in response thereto;

a first system for producing the oxygen-expulsion gas or for extracting oxygen from the enclosed space to produce said base inerting level;

a second system for rapidly feeding an oxygen-expulsion gas into the enclosed space to produce the complete inerting level;

a fire detector for detecting a fire characteristic in the enclosed space and producing a complete inerting signal in response thereto, and a control unit responsive to the base inerting signal and the complete inerting signal for sending a first control signal to the first system to maintain said base inerting level within the enclosed space, and sending a second control signal to the second system in response to said complete inerting signal to achieve said complete inerting level.

10. The device according to claim 9, wherein the fire detector comprises an aspirative fire detection device having a housing.

11. The device according to claim 10, wherein the oxygen measuring device is integrated into the housing of the fire detection device.

* * * * *